US007744442B2

(12) United States Patent
Rettberg et al.

(10) Patent No.: US 7,744,442 B2
(45) Date of Patent: Jun. 29, 2010

(54) DOLLS WITH ALTERABLE FACIAL FEATURES

(75) Inventors: Tim Rettberg, Seal Beach, CA (US); Joe C. Ward, La Miranda, CA (US); Tsui Yiu Sang, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 11/759,795

(22) Filed: Jun. 7, 2007

(65) Prior Publication Data

US 2008/0014831 A1 Jan. 17, 2008

Related U.S. Application Data

(60) Provisional application No. 60/812,199, filed on Jun. 9, 2006.

(51) Int. Cl.
*A63H 3/28* (2006.01)
*A63H 3/24* (2006.01)
*A63H 3/40* (2006.01)
*A63H 3/48* (2006.01)

(52) U.S. Cl. ..... 446/301; 446/304; 446/337; 446/341

(58) Field of Classification Search ..... 446/300, 446/301, 304, 337–343
See application file for complete search history.

(56) References Cited

U.S. PATENT DOCUMENTS 1,432,205 A 10/1922 Petrow
1,489,385 A * 4/1924 Ciavatti ..... 446/341
1,618,571 A 2/1927 Christensen
1,782,786 A 11/1930 Marx
1,805,231 A * 5/1931 Blaustein ..... 446/190

(Continued)

FOREIGN PATENT DOCUMENTS

GB 2077117 12/1981

(Continued)

OTHER PUBLICATIONS

International Search Report, Aug. 27, 2008, 2 pages, U.S. Patent and Trademark Office.

(Continued)

*Primary Examiner*—Gene Kim
*Assistant Examiner*—Alyssa M Hylinski
(74) *Attorney, Agent, or Firm*—Kolisch Hartwell, P.C.

(57) ABSTRACT

Toy dolls include a head having a face having an alterable appearance and a mechanism for altering the appearance of the face. The mechanism may include a first element configured to pivot about a first axis between a first position and a second position, a second element operatively coupled to the first element and configured to pivot about a second axis between a third position and a fourth position in response to the first element pivoting from the first position to the second position, and a third element operatively coupled to the first element and configured to pivot about a third axis between a fifth position and a sixth position in response to the first element pivoting from the first position to the second position. Pivoting the second element may alter a first aspect of the appearance of the face, and pivoting the third element may alter a second aspect of the appearance of the face.

13 Claims, 6 Drawing Sheets

U.S. PATENT DOCUMENTS

| | | | | | |
|---|---|---|---|---|---|
| 2,148,888 | A | | 2/1939 | Wittmann | |
| 2,274,694 | A | | 3/1942 | Henry | |
| 2,300,079 | A | | 10/1942 | Wheeler | |
| 2,300,080 | A | | 10/1942 | Wheeler | |
| 2,641,866 | A | * | 6/1953 | Schiller | 446/342 |
| 2,686,388 | A | * | 8/1954 | Seidl | 446/340 |
| 2,818,678 | A | * | 1/1958 | Lemelson | 446/190 |
| 3,006,110 | A | | 10/1961 | Neff et al. | |
| 3,053,009 | A | * | 9/1962 | Ostrander | 446/306 |
| 3,125,826 | A | * | 3/1964 | Ostrander | 446/301 |
| 3,195,269 | A | * | 7/1965 | Weih et al. | 446/340 |
| 3,237,344 | A | | 3/1966 | Ostrander | |
| 3,383,795 | A | * | 5/1968 | Ryan et al. | 446/304 |
| 3,406,482 | A | * | 10/1968 | Ryan et al. | 446/304 |
| 3,445,955 | A | * | 5/1969 | Mucciante et al. | 446/183 |
| 3,448,540 | A | * | 6/1969 | Mucciante et al. | 446/337 |
| 3,494,068 | A | | 2/1970 | Crosman | |
| 3,583,093 | A | * | 6/1971 | Glass et al. | 446/299 |
| 3,641,703 | A | * | 2/1972 | Tepper et al. | 446/295 |
| 3,699,707 | A | * | 10/1972 | Sapkus | 446/131 |
| 3,745,696 | A | | 7/1973 | Sapkus et al. | |
| 3,828,469 | A | | 8/1974 | Giroud | |
| 3,841,020 | A | | 10/1974 | Ryan et al. | |
| 3,918,199 | A | * | 11/1975 | De Masi | 446/301 |
| 4,033,071 | A | * | 7/1977 | Strongin et al. | 446/177 |
| 4,074,460 | A | * | 2/1978 | Thorn et al. | 446/304 |
| 4,232,478 | A | * | 11/1980 | Terzian | 446/304 |
| 4,244,139 | A | * | 1/1981 | Erickson et al. | 446/304 |
| 4,276,714 | A | * | 7/1981 | Albert et al. | 446/300 |
| 4,294,033 | A | * | 10/1981 | Terzian | 446/190 |
| 4,725,627 | A | | 2/1988 | Arnason et al. | |
| 4,805,328 | A | | 2/1989 | Mirahem | |
| 5,108,341 | A | * | 4/1992 | DeSmet | 446/299 |
| 5,190,492 | A | * | 3/1993 | Berenguer | 446/301 |
| 5,290,198 | A | * | 3/1994 | Nakayama | 446/297 |
| 5,376,038 | A | | 12/1994 | Arad et al. | |
| 5,679,050 | A | * | 10/1997 | LLorens | 446/341 |
| 5,906,531 | A | | 5/1999 | Llorens | |
| 6,068,536 | A | | 5/2000 | Madland et al. | |
| 6,110,001 | A | | 8/2000 | Chae | |
| 6,315,631 | B1 | * | 11/2001 | Beckman et al. | 446/297 |
| 6,497,607 | B1 | * | 12/2002 | Hampton et al. | 446/301 |
| 6,503,123 | B2 | | 1/2003 | Chung | |
| 6,733,359 | B1 | * | 5/2004 | Jacobs | 446/300 |
| 6,767,271 | B2 | | 7/2004 | Tsui | |
| 6,793,553 | B2 | | 9/2004 | Willett | |
| 6,988,928 | B2 | | 1/2006 | Willett | |
| 7,021,988 | B2 | | 4/2006 | Patton | |
| 2001/0046829 | A1 | | 11/2001 | Chung | |
| 2002/0111112 | A1 | | 8/2002 | Willett | |
| 2005/0287913 | A1 | | 12/2005 | Ellman et al. | |
| 2007/0128979 | A1 | | 6/2007 | Shackelford et al. | |

FOREIGN PATENT DOCUMENTS

| | | |
|---|---|---|
| GB | 2308310 | 6/1997 |

OTHER PUBLICATIONS

Written Opinion, Aug. 27, 2008, 7 pages, U.S. Patent and Trademark Office.

* cited by examiner

DOLLS WITH ALTERABLE FACIAL FEATURES

RELATED APPLICATION

This application is based upon and claims priority under 35 U.S.C. §119(e) to U.S. Provisional Application Ser. No. 60/812,199, entitled "DOLL WITH MECHANICAL REACTION TO FEEDING BOTTLE," filed on Jun. 9, 2006, the content of which is incorporated herein by reference in its entirety for all purposes.

BACKGROUND

The present disclosure relates to toy dolls, and more particularly to toy dolls having alterable facial features.

Examples of toy dolls that have alterable facial features are disclosed in the following patent documents, the entire discloses of which are incorporated herein by reference in their entireties for all purposes: U.S. Pat. Nos. 6,733,359, 6,110,001, 5,679,050, 3,237,344, 2,686,388, and 3,053,009.

SUMMARY

Toy dolls according to the present disclosure may include a head including a first movable facial feature, a second movable facial feature, and a mechanism for moving the first and second movable facial features. In some embodiments the mechanism includes an input lever configured to pivot about a first axis, a first output lever configured to pivot about a second axis and coupled to the first movable facial feature and the input lever and, and a second output lever configured to pivot about a third axis and coupled to the second movable facial feature and the input lever.

In some embodiments, when the toy doll is in a first orientation, pivoting the input lever about the first axis pivots the first and second output levers about the second and third axes, respectively.

In some embodiments, the first, second, and third axes are generally parallel and when the toy doll is in a first orientation, pivoting the input lever in a first direction causes the second output lever to pivot in the first direction and further causes the first output lever to pivot in a second direction opposite the first direction.

In some embodiments, the movable facial features include one or more cheeks and/or one or more eyes.

In some embodiments, the toy doll further includes a sound generator configured to output a sound when the input lever is pivoted from a first position to a second position.

DETAILED DESCRIPTION

Dolls according to the present disclosure may be configured with various features that activate in response to user manipulation. For example, a doll may produce various sounds in response to various user manipulations. Non-exclusive examples of sounds that a doll may produce include, but are not limited to, gurgling sounds in response to a toy baby bottle, toy pacifier, or other object being placed in the mouth of the doll and giggling sounds in response to the doll's stomach being squeezed or pushed. Other examples of sounds may include crying, talking, and other various baby sounds. Other examples of user manipulation may include cradling the doll, rocking the doll, squeezing various parts of the doll, manipulating one or more limbs of the doll, manipulating the head of the doll, etc.

In addition to producing various sounds, a doll's physical appearance may change in response to user manipulation. For example, a doll's eyes may close, or at least appear to close, in response to a toy baby bottle or other object being placed in the mouth of the doll. Additionally or alternatively, a doll may smile, or appear to smile, in response the doll's stomach being pushed. These and other physical changes may, but are not required to, coincide with the various sounds discussed above.

Figure 1:
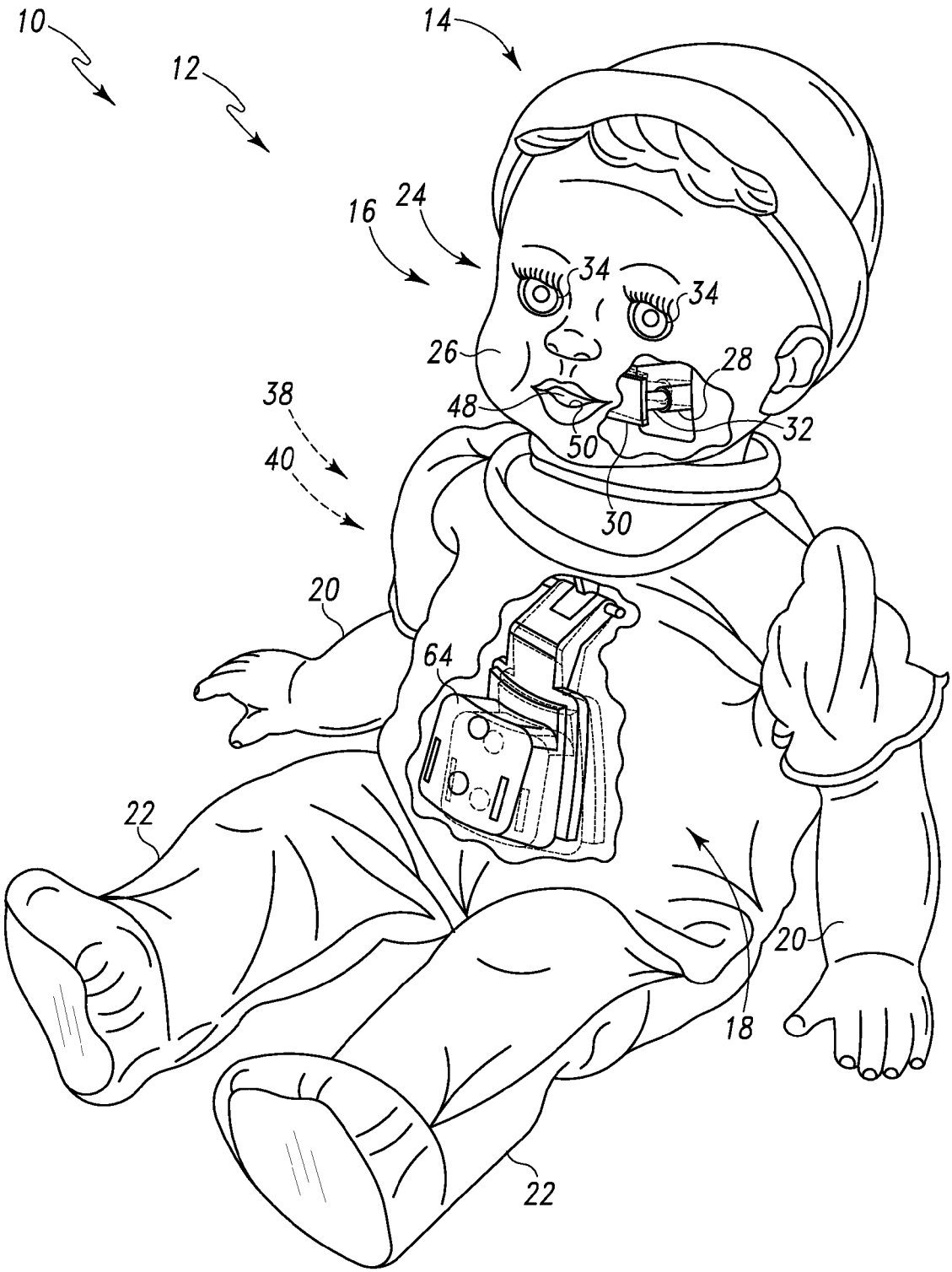
FIG. 1 is a partial cut-away isometric view of a toy doll according to the present disclosure, illustrating an input lever extending along the torso of the toy doll and an output lever for engaging the inside surface of a cheek of the toy doll.

A non-exclusive example of a toy doll 10 according to the present disclosure is illustrated in FIG. 1 and is generally indicated at 12. As illustrated, dolls 10 may include a head 14 with a face 16, a torso 18, arms 20, and legs 22; however, dolls 10 are not limited to human and/or standard doll configurations. The head may be constructed of a hard plastic covered in a flexible skin of soft plastic. Suitable materials that may be used to construct the head and/or other components of dolls according to the present disclosure include, but are not limited to, injection molded polyvinyl chloride (PVC) and acrylonitrile butadiene styrene (ABS).

Dolls 10 may include one or more alterable, or movable, facial features 24. For example, doll 12 includes cheeks 26 constructed of a flexible material and configured to move relative to the rest of the doll's face, thereby altering its appearance. In the non-exclusive doll 12, the cheeks are configured to move upward relative to the doll's mouth and thereby effectuate the appearance of a smile, or grin. In FIG. 1, one of the doll's cheeks is cut-away to reveal a portion of an output lever 28 configured to move the doll's cheeks. Lever 28 includes two generally cylindrically shaped hollow end portions, one of which is shown behind the doll's left cheek in a first, or non-smiling, position in solid lines and in a second, or smiling, position in dashed lines. Lever 28 of doll 12 may also be described as a cheek-engagement lever.

Doll 12 also includes plates 30 adhered to the inside surface of the doll's cheeks and a post 32 attached to the plate. Post 32 is coupled to the hollow end portion of lever 28. Accordingly, when lever 28 pivots, the corresponding cheeks of the doll move and thereby alter its appearance.

Doll 12 also includes eyes 34 configured to open and close and thereby further alter the appearance of the doll's face. In FIG. 1, the doll's eyes are shown in a first, or open, position, but may also be positioned so that they appear closed, as described in more detail below.

Other movable facial features are equally within the scope of the present disclosure and dolls 10 are not limited to movement of cheeks and/or eyes. For example, one or more of noses, chins, foreheads, ears, mouths, and/or other facial features may also be configured for movement in dolls 10.

Figure 2:
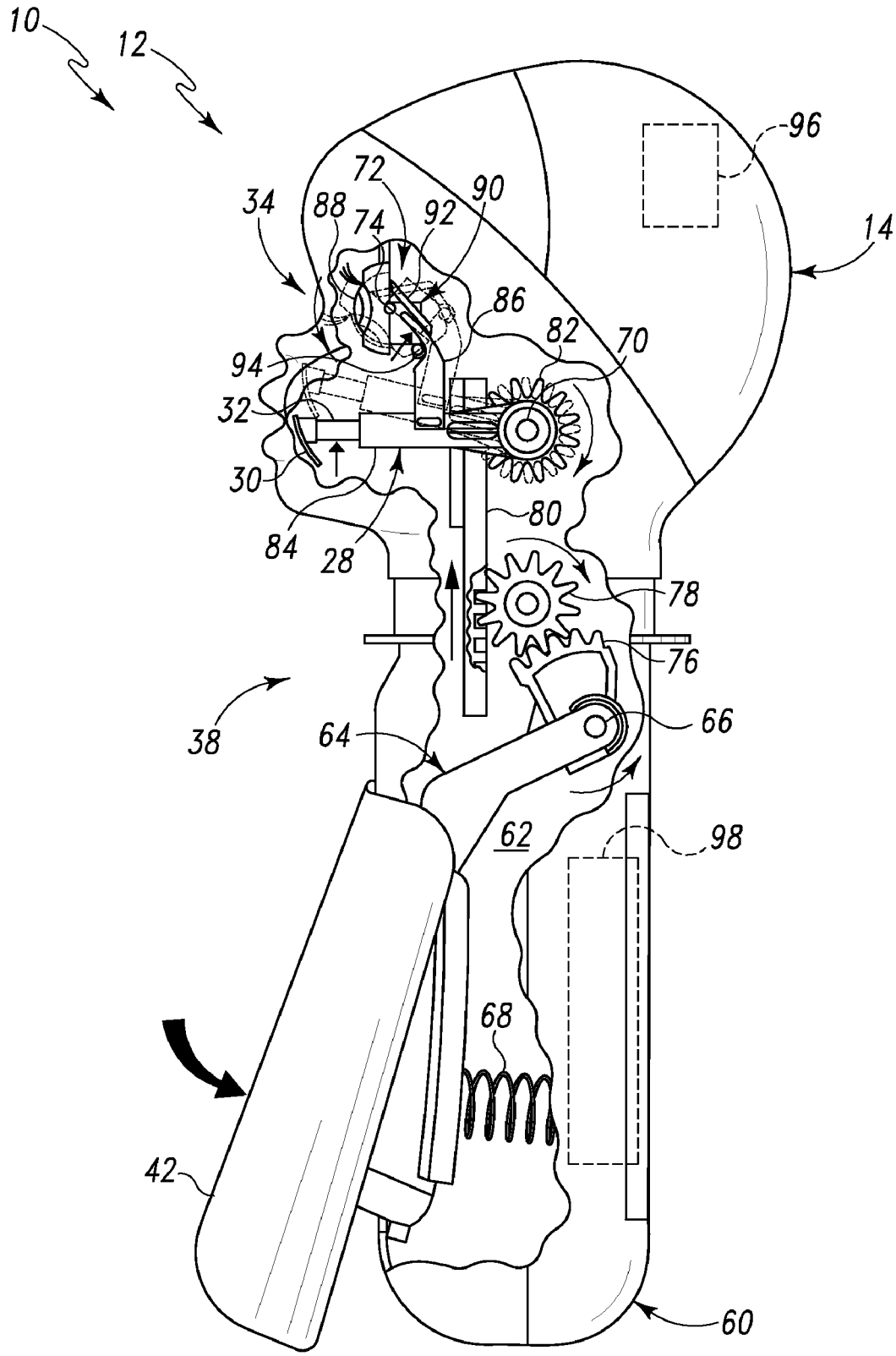
FIG. 2 is a partial cut-away side view of a portion of a toy doll according to the present disclosure, illustrating a mechanism for moving movable facial features, including cheeks and eyes of the toy doll.

Dolls 10 further may include a mechanism 38 for moving the one or more movable facial features present in dolls according to the present disclosure. Mechanism 38 may include at least one actuator 40 configured to be engaged by a user to effectuate movement of one or more movable facial features 24. The non-exclusive toy doll 12 illustrated in FIGS. 1 and 2 includes a first actuator 42 extending along the doll's torso 18. When a user squeezes or otherwise pushes on the torso, output lever 28 is configured to move from its first position to its second position. In FIG. 1, portions of the doll are cut-away to reveal an input lever 64, to which actuator 42 is attached (as shown in FIG. 2). Input lever 64 is shown in solid lines in FIG. 1 in a first, or non-engaged, position and in dashed lines in a second, or engaged, position.

Mechanism 38 of non-exclusive toy doll 12 may further include a second actuator, or input member, 48 disposed behind a mouth opening 50. When doll 12 is in a first, or upright, orientation as illustrated in FIG. 1, and when a user inserts an object such as the nipple of a toy baby bottle or toy pacifier through the doll's mouth opening to engage and translate the second actuator 48, the eyes are configured to move from their first open position to their second closed position. When doll 12 is in a second, or laid-back, orientation (not illustrated), engagement and translation of the second actuator 48 may not reposition the eyes. Rather, doll 12 may be configured so that when the doll is reoriented from the upright orientation to the laid-back orientation, the eyes automatically reposition form their open position to their closed position. Therefore, when doll 12 is already in the laid-back orientation, translation of the input member 48 does not reposition the eyes. This automatic repositioning of the eyes when the doll is reoriented between upright and laid-back orientations is not required in all embodiments of dolls according to the present disclosure. Input member 48, in some embodiments, may also be described as a tongue member.

FIG. 2 is a cut-away partial cross-sectional side view of a portion of toy doll 12 and illustrates at least a portion of a mechanism 38 suitable for implementing one or more of the doll features discussed above. As shown, doll 12 includes a head 14 attached to a torso portion 60. Mechanism 38 may be housed at least partially within an internal cavity 62 defined by the head and torso portion.

Mechanism 38 of doll 12 includes an input lever 64 configured to pivot about a first axis 66, a first output (cheek-engagement) lever 28 configured to pivot about a second axis 70, and a second output, or eye-positioning, lever 72 configured to pivot about a third axis 74. The cheek-engagement and eye-positioning levers may be coupled to the input lever 64 via a first gear portion 76 fixedly attached to the input lever, a pinion gear 78 mounted in the internal cavity and engaged with the first gear portion, a rack 80 slidingly mounted in the internal cavity and engaged with the pinion gear, and an output gear 82 fixedly attached to the cheek-engagement lever and engaged with the rack. Gear portion 76, pinion gear 78, rack 80, and output gear 82 may all be described as being part of a mechanism 38. Mechanism 38 may also include a spring, or other biasing member, 68 configured to bias the input lever to a first position where the cheeks and eyes (when the doll is upright) are in their first, or non-altered, positions.

Accordingly, when doll 12 is in an upright orientation, pivoting of the input lever about the first axis in a first direction pivots the cheek-engagement lever in a second direction opposite the first direction, and further pivots the eye-positioning lever about the third axis in the first direction, as illustrated by the various arrows indicated in FIG. 2.

As mentioned, cheek-engagement lever 28 may include two hollow end portions 84 that engage posts 32 attached to the inside surface of the doll's cheeks. Lever 28 may also include an arm 86 extending from one of the end portions 84. Arm 86, when present, engages the eye-positioning lever 72.

Eye-positioning lever 72 may include eye-ball portions 88 and a beam 90 that extends between and behind the eye-ball portions. Beam 90 may include an arm 92 positioned to engage the arm 86 of the cheek-engagement lever. Beam 90 may also include a rod 94 that provides a suitable weight for establishing a center of gravity of the entire eye-positioning lever 72 behind (relative to the doll's face) the third axis 74. Accordingly, when the doll is reoriented from an upright orientation to a laid-back orientation, the eye-positioning lever may automatically pivot about the third axis to give the appearance of the eyes closing.

In FIG. 2, cheek-engagement lever 28 and eye-positioning lever 72 are illustrated in their first, or non-altered, positions in solid lines, and in their second, or altered, positions in dashed lines. When the cheek-engagement lever pivots from its first position to its second position, as indicated by the arrow in FIG. 2, the end of arm 86 of the cheek-engagement lever slides along the arm 92 of the eye-positioning lever and forces the eye-positioning lever to pivot about the third axis to its second position. However, in embodiments incorporating eye-positioning levers that are configured to automatically pivot in response to the doll being reoriented to a laid-back orientation, when the doll is already in the laid-back orientation, pivoting of the cheek-engagement lever will not pivot the eye-positioning lever.

As discussed above, dolls according to the present disclosure may be configured to produce various sounds in response to various user manipulations of the dolls. Accordingly, such sounds may be prerecorded and stored electronically within electrical components housed within the dolls, schematically illustrated at 96 and 98. Various electrical components may be incorporated that are configured to functionally and effectively perform, trigger, produce, etc. the sound functions discussed herein, and may include (but are not limited to) speakers, switches, circuits, processors, storage media, transducers, resisters, capacitors, etc. For example, a switch may be positioned behind input lever 64 so that when a user engages actuator 42 and causes the input lever to pivot about the first axis, a portion of the input lever will engage the switch and trigger a predetermined sound, such as a giggling sound. Accordingly, a giggling or other sound may coincide with the doll's cheeks moving and giving the appearance of the doll smiling or grinning. One or more components associated with sound generation may be collectively referred to as a sound generator.

Figure 3:
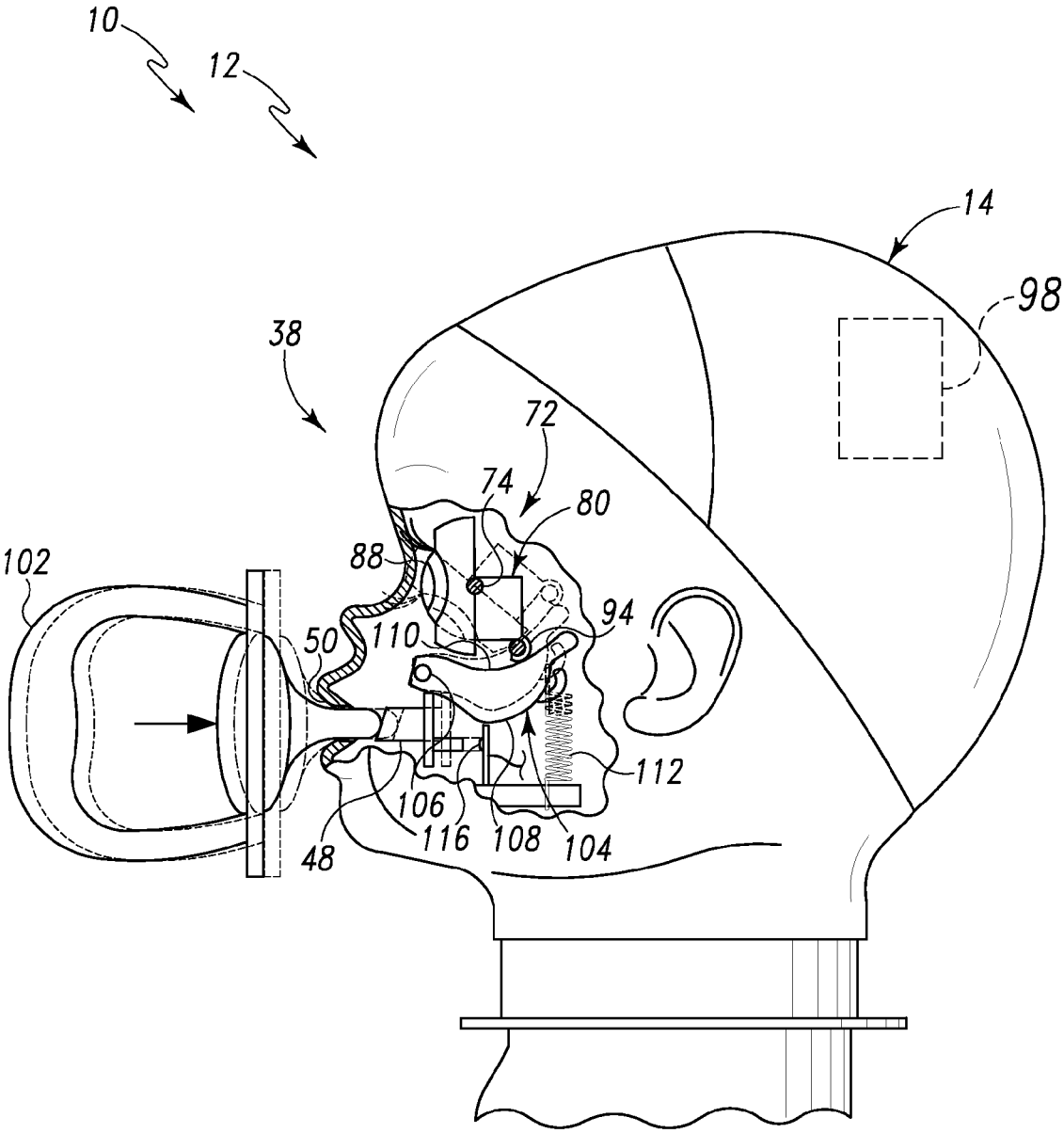
FIG. 3 is a partial cut-away side view of a portion of a toy doll according to the present disclosure, illustrating a mechanism for moving movable eyes of the toy doll.

FIG. 3 illustrates a portion of mechanism 38 not illustrated in FIG. 2. As mentioned, mechanism 38 may be further configured to reposition the eyes when an object, such as a toy pacifier 102, is inserted through the mouth opening 50. Mechanism 38 accordingly includes second actuator, or input member, 48 disposed behind the mouth opening 50 and configured to be linearly translated. Mechanism 38 also includes a transition lever 104 configured to pivot about a fourth axis 106.

Transition lever 104 includes a first surface 108 and a second surface 110 generally opposite the first surface. The first surface is in sliding contact with the input member 48 so that when the input member is engaged and translated by an object inserted through the mouth opening (e.g., toy pacifier 102), the transition lever pivots about the fourth axis. The second surface 110 of the transition lever is in sliding contact with the beam 90 of the eye-positioning lever 72 so that when the transition lever pivots, the eye-positioning lever is forced to pivot about the third axis. A spring 112 biases the transition lever to a default position where, when the doll is in an upright orientation, the eyes are in their first, or open condition. Accordingly, when a user inserts an object such as a toy pacifier through the doll's mouth opening, the input member pivots the transition lever against the force of the spring, which in turn pivots the eye-positioning lever and makes the doll's eyes appear to close.

The non-exclusive doll 12 illustrated in FIG. 3 also includes a switch 116 positioned behind input member 48 so that when an object is inserted through the doll's mouth opening and translates the input member, a portion of the input member will engage the switch and trigger a corresponding sound, such a gurgling, or other baby, sound. Therefore, a gurgling sound may coincide with a toy baby bottle being inserted through the mouth opening. Additionally or alternatively, the various electronics may be configured so that when the toy baby bottle, or other object, is removed from the mouth opening, a different predetermined sound is triggered, such as a cooing, or other sound of satisfaction, or crying, or other sound of dissatisfaction, corresponding to the baby bottle, or other object, being taken away from the toy doll.

Figure 4:
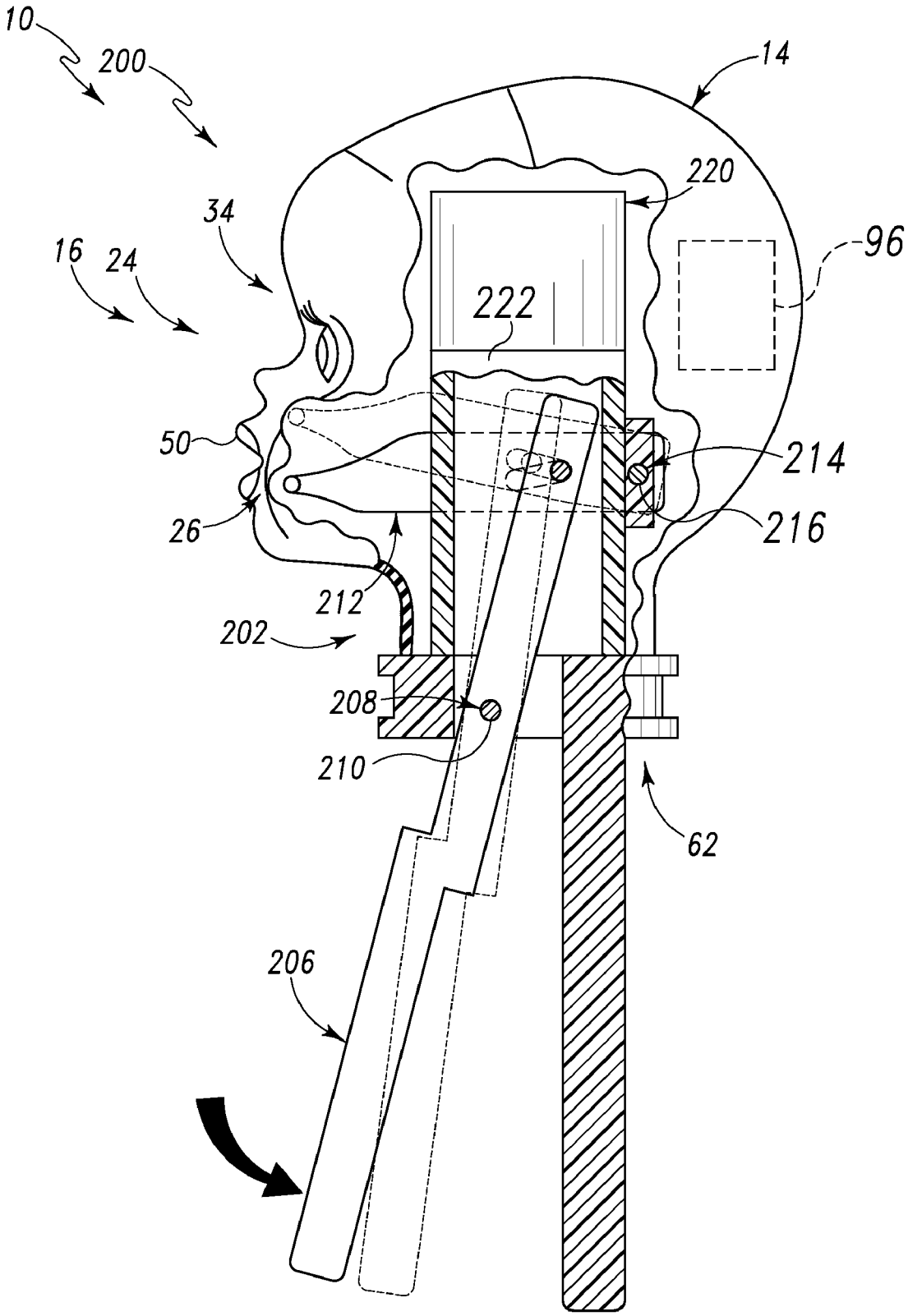
FIG. 4 is a partial cut-away side view of a portion of a toy doll according to the present disclosure, illustrating a mechanism for moving movable cheeks of the toy doll.
Figure 5:
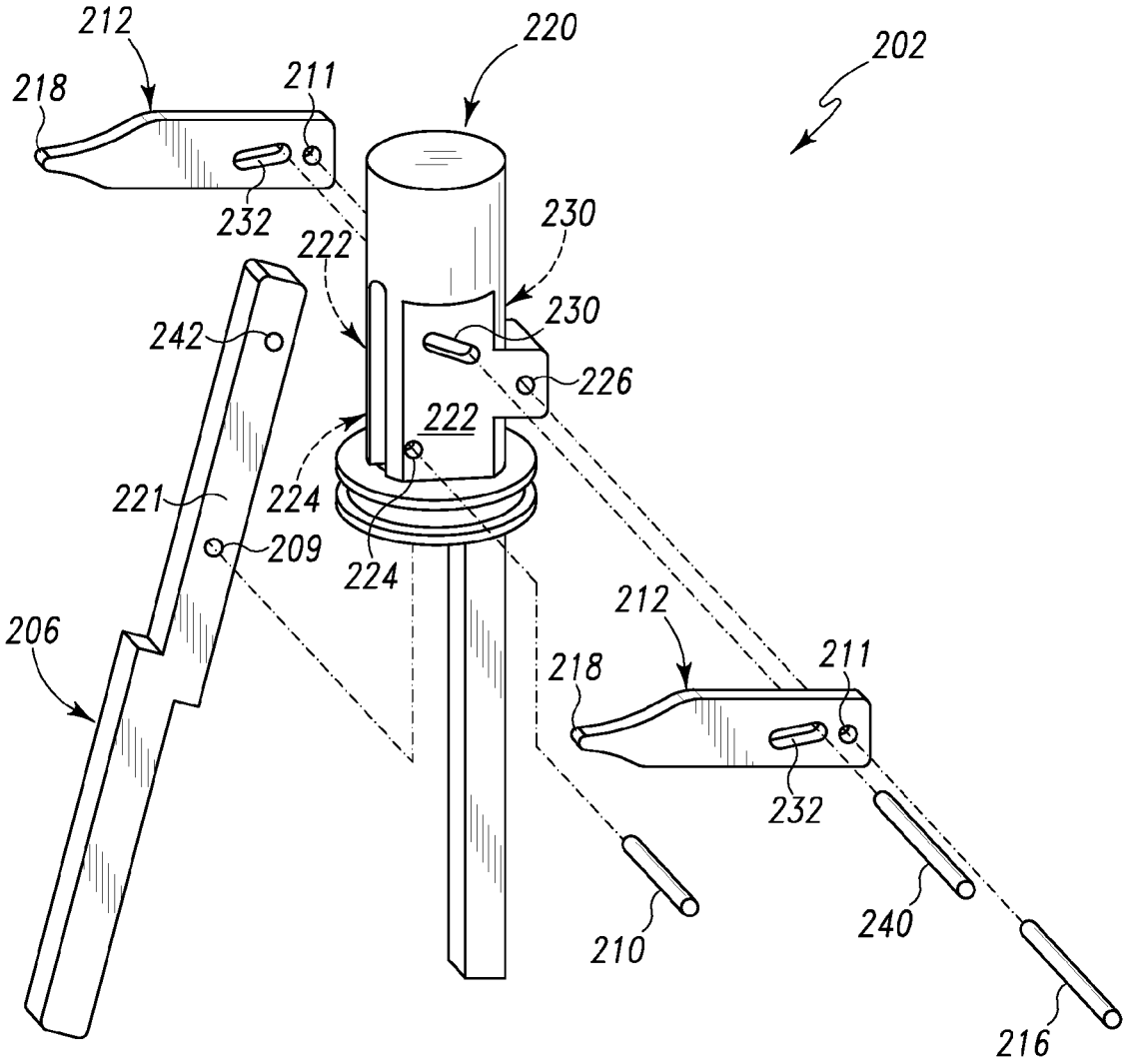
FIG. 5 is an exploded isometric view of the mechanism of FIG. 4.
Figure 6:
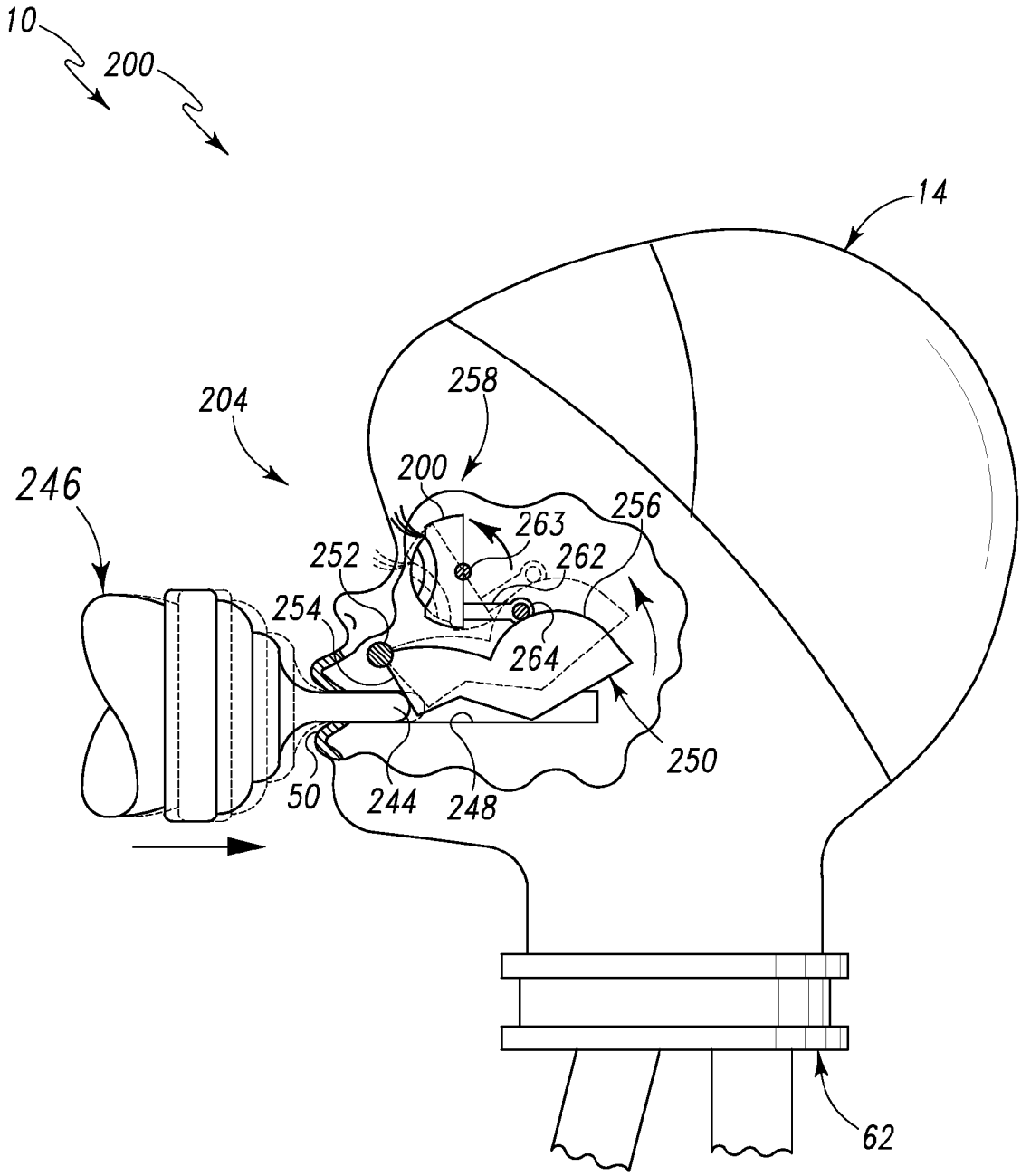
FIG. 6 is a partial cut-away side view of a portion of a toy doll according to the present disclosure, illustrating a mechanism for moving movable eyes of the toy doll.

Turning now to FIGS. 4-6, portions of a second example of a toy doll 10 are illustrated. The second example is generally indicated at 200. Like doll 12 described above, and using the same reference numbers for similar features, doll 200 includes a head 14 with a face 16 having alterable facial features 24 including cheeks 26 and eyes 34. Head 14 also includes a mouth opening 50. Like doll 12, the head and torso of doll 200 define an internal cavity 62. Doll 200 also includes two mechanisms for moving the movable facial features. A first mechanism 202 is illustrated in FIGS. 4 and 5 and is configured to move the cheeks in response to user manipulation of the doll. A second mechanism 204 is illustrated in FIG. 6 and is configured to move the eyes in response to user manipulation of the doll.

Doll 200 may also include various electronics suitable for producing sound effects as discussed above and schematically illustrated in FIG. 4 at 96.

Referring to FIGS. 4 and 5, first mechanism 202 may include an input lever 206 configured to pivot about a first axis 208 defined by a first pin 210. Input lever 206 may include a hole 209, through which pin 210 extends. Mechanism 202 may further include a pair of output, or cheek-engagement, levers 212 configured to pivot about a second axis 214 defined by a second pin 216. Output levers 212 include holes 211, through which pin 216 extends. The output levers 212 also include ends 218 that are in contact with the inside surface of the cheeks 26. Accordingly, when levers 212 pivot about axis 214, the cheeks move to effectuate a smile, or grin.

Mechanism 202 also includes a support structure 220 fixedly mounted in internal cavity 62. Structure 220 is a somewhat cylindrical structure that is at least partially hollow to receive an upper portion 221 of input lever 206, and includes planar surfaces 222 on which the output levers 212 slide when they pivot. Structure 220 includes holes 224 for receiving pin 210 and thereby defining the first axis 208 for the input lever to pivot about. Structure 220 also includes a hole 226 for receiving pin 216 and thereby defining the second axis 214 for the output levers 212 to pivot about.

As viewed with the doll in a generally upright orientation, structure 220 includes a pair of slots 230 extending through the walls of structure 202 from the planar surfaces 222. Slots 230 are positioned at a sloped angle such that ends of the slots nearer the doll's face are higher than the ends of the slots further from the doll's face. Conversely, the pair of output levers 212 each include a slot 232 positioned such that when the output levers are in a first, or non-smiling, position, the ends of the slots 232 nearer the doll's face are below the corresponding ends of the slots 230 in structure 220.

A third pin 240 extends through slots 230, 232 and a hole 242 positioned in the upper portion 221 of the input lever. Accordingly, when the input lever is pivoted about axis 208, the pin 240 slides along slots 230, thereby forcing output levers 212 to pivot upward (as viewed when the doll is in an upright orientation) as pin 240 slides along slots 232.

As mentioned, doll 200 includes a second mechanism 204 configured to move the eyes in response to user manipulation of the doll. More specifically, and as illustrated in FIG. 6, mechanism 204 is configured to close the eyes of the doll in response to an object, such as the nipple 244 of a toy baby bottle 246, being inserted through the mouth opening 50 of the doll.

Mechanism 204 includes an input region, or passage, 248 positioned behind the mouth opening and adapted to receive a suitable object. Mechanism 204 further includes an input lever 250 configured to be engaged by the inserted object and to pivot about an axis 252 in response thereto. The input lever therefore includes an engagement surface 254 positioned within the input region, and a cam surface 256 configured to engage an output, or eye-positioning, lever 258.

Output lever 258 includes an eye portion 260 and an arm 262 in sliding contact with cam surface 256, at least when the doll is in the upright orientation. Output lever 258 pivots about an axis 263. Arm 262 may include a rod 264 of sufficient weight to establish a center of gravity of the entire eye-positioning lever 258 so that when the doll is reoriented from an upright orientation to a laid-back orientation, the eye-position lever automatically pivots about axis 263.

Toy dolls according to the present disclosure have been described above and illustrated in the accompanying figures according to specific embodiments; however, the present disclosure is not limited to such specific embodiments. For example, a non-exclusive example of a toy doll according to the present disclosure may be described as comprising a head that includes a first movable facial feature and a second movable facial feature, and a mechanism for moving the first and second movable facial features. The mechanism may include an input lever configured to pivot about a first axis, a first output lever coupled to the first movable facial feature, coupled to the input lever, and configured to pivot about a second axis, and a second output lever coupled to the second movable facial feature, coupled to the input lever, and configured to pivot about a third axis. In such embodiments, when the toy doll is in a first orientation, pivoting the input lever about the first axis pivots the first and second output levers about the second and third axes, respectively.

Additionally or alternatively, the first movable facial feature may (but is not required to) include one or more cheeks of the toy doll, and the second movable facial feature may (but is not required to) include one or more eyes. Furthermore, the second output lever may be configured to move the one or more eyes from an open condition to a closed condition.

Additionally or alternatively, the second output lever may be coupled to the input lever via the first output lever so that pivoting the input lever about the first axis pivots the first output lever about the second axis, which in turn pivots the second output lever about the third axis.

Additionally or alternatively, when the toy doll is in a second orientation, pivoting the input lever about the first axis may pivot the first output lever but may pivot not the second output lever.

Additionally or alternatively, the first, second, and third axes may be generally parallel and when the toy doll is in the first orientation pivoting the input lever in a first direction may cause the second output lever to pivot in the first direction and further may cause the first output lever to pivot in a second direction opposite the first direction.

Additionally or alternatively, the mechanism may further include an input member coupled to the second output lever and configured to be generally linearly translated, and when the toy doll is in the first orientation, translation of the input member pivots the second output lever.

Additionally or alternatively, the head may include a mouth opening and the input member may be positioned behind the mouth opening to be engaged by an object inserted through the mouth opening.

Additionally or alternatively, the toy doll may further include a sound generator configured to output a first sound when the input lever is pivoted from a first position to a second position and further configured to output a second sound when the input member is translated.

Additionally or alternatively, the toy doll may further include a sound generator configured to output a sound when the input lever is pivoted from a first position to a second position.

Additionally or alternatively, the toy doll may further include a torso portion coupled to the head so that the head and the torso portion define an internal cavity and the input lever, the first output lever, and the second output lever are mounted in the internal cavity. In such embodiments, the mechanism may further include a first gear portion fixedly attached to the input lever, a pinion gear mounted in the internal cavity and engaged with the first gear portion, a rack slidingly mounted in the internal cavity and engaged with the pinion, and an output gear fixedly attached to the first output lever and engaged with the rack.

Additionally or alternatively, the head of the first toy doll may further include a mouth opening, and the mechanism may further include an input member coupled to the second output lever, configured to be generally linearly translated, and positioned within the mouth opening to be engaged by an object inserted in the mouth opening, and a transition lever configured to pivot about a fourth axis, the transition lever in contact with the input member at a first portion and, when the toy doll is in the first orientation, in contact with the second output lever at a second portion. In such embodiments, when the toy doll is in the first orientation, translation of the input member may pivot the second output lever.

Another non-exclusive example of a toy doll according to the present disclosure may be described as comprising a head including a face having an eye, a cheek, and a mouth opening; a torso coupled to the head; and a mechanism for altering the appearance of the face. The mechanism may include an input lever integral to the torso and configured to pivot about a first axis; a cheek-engagement lever coupled to an inside surface of the cheek, coupled to the input lever, and configured to pivot about a second axis so that at least a portion of the cheek moves, wherein the second axis is generally parallel to the first axis; an eye-positioning lever coupled to the eye, coupled to the input lever via the cheek-engagement lever, and configured to pivot about a third axis so that the eye appears to close, wherein the third axis is generally parallel to the first axis; a tongue member positioned behind the mouth opening, the tongue member coupled to the eye-positioning lever, and configured to be engaged by an object inserted through the mouth opening and translate relative to the mouth opening; and a sound generator configured to output a first sound when the input lever is pivoted from a first position to a second position and further configured to output a second sound when the tongue member is translated. In such embodiments, when the toy doll is generally in an upright orientation, pivoting the input lever in a first direction may cause the eye-positioning lever to pivot in the first direction and further may cause the cheek-engagement lever to pivot in a second direction opposite the first direction.

Yet another non-exclusive example of a toy doll according to the present disclosure may be described as comprising a head including a face having an alterable appearance, and a mechanism for altering the appearance of the face and operatively coupled to the head. In such embodiments, the mechanism may include a first element configured to pivot about a first axis between a first position and a second position, a second element operatively coupled to the first element and configured to pivot about a second axis between a third position and a fourth position in response to the first element pivoting from the first position to the second position. In such embodiments, pivoting of the second element may alter a first aspect of the appearance of the face. The mechanism may further include a third element operatively coupled to the first element and configured to pivot about a third axis between a fifth position and a sixth position in response to the first element pivoting from the first position to the second position, wherein pivoting of the third element alters a second aspect of the appearance of the face.

Additionally or alternatively, the toy doll may further include a torso portion, and the mechanism may further include an actuator extending along the torso portion, fixedly coupled to the first element, and configured to pivot the first element from the first position to the second position when the actuator is moved by a user.

Additionally or alternatively, the second element may be operatively coupled to a cheek of the doll's face, wherein the cheek is in a seventh position when the second element is in the third position and the cheek is in an eighth position when the second element is in the fourth position.

Additionally or alternatively, the third element may include at least one eye, wherein the eye appears to be open when the third element is in the fifth position and the eye appears to be closed when the third element is in the sixth position.

Additionally or alternatively, the first, second, and third axes may be generally parallel with each other and when the toy doll is in a first orientation pivoting the first element in a first direction may cause the third element to pivot in the first direction and further may cause the second element to pivot in a second direction opposite the first direction.

Additionally or alternatively, when the toy doll is in a second orientation, the third element is in the sixth position regardless of the position of the first element.

Additionally or alternatively, the first orientation of the toy doll may be a generally upright orientation and the second orientation of the toy doll may be a generally laid-back orientation.

Additionally or alternatively, pivoting the first element may cause the third element to pivot, but pivoting the third element may not cause the first element to pivot.

Additionally or alternatively, the mechanism may further include a fourth element operatively coupled to the third element and configured to translate between a seventh position and an eighth position, and when the toy doll is in a first orientation, translating the fourth element may pivot the third element from the fifth position to the sixth position.

Additionally or alternatively, the head may further include a mouth opening, and the fourth element may be positioned behind the mouth opening and may be configured to be engaged by an object inserted through the mouth opening.

Additionally or alternatively, toy dolls may further include a sound generator configured to output a first sound when the first element is pivoted to the second position and may be further configured to output a second sound when the fourth element is translated to the eighth position.

Yet another non-exclusive example of a toy doll according to the present disclosure may be described as comprising a head including a first movable facial feature and a second movable facial feature and a first mechanism for moving the first movable facial feature. The first mechanism may include a first input lever configured to pivot about a first axis and a first output lever coupled to the first movable facial feature and the first input lever, and configured to pivot about a second axis. The toy doll may further include a second mechanism for moving the second movable facial feature. The second mechanism may include a second input lever configured to pivot about a third axis and a second output lever coupled to the second movable facial feature and the second input lever, and configured to pivot about a fourth axis. In such embodiments, pivoting the first input lever may pivot the first output lever, and when the toy doll is in a first orientation, pivoting the second input lever may pivot the second output lever.

Additionally or alternatively, the first movable facial feature may include one or more cheeks of the toy doll.

Additionally or alternatively, the second movable facial feature may include one or more eyes and the second output lever may be configured to move the one or more eyes from an open condition to a closed condition.

Additionally or alternatively, when the toy doll is in a second orientation, pivoting the first input lever may pivot the first output lever, but pivoting the second input lever may not pivot the second output lever.

Additionally or alternatively, the first, second, third and fourth axes may be generally parallel, and pivoting the input lever in a first direction may cause the first output lever to pivot in a second direction opposite the first direction. Furthermore, pivoting the second input lever in the first direction may cause the second output lever to pivot in the first direction.

Additionally or alternatively, the head may include a mouth opening and the second input lever may be positioned behind the mouth opening to be engaged by an object inserted through the mouth opening.

Additionally or alternatively, the toy doll may further include a sound generator configured to output a first sound when the first input lever is pivoted and further configured to output a second sound when the second input lever is pivoted.

Additionally or alternatively, the toy doll may further include a torso coupled to the head such that the head and the torso define an internal cavity and the first input lever, the first output lever, the second input lever, and the second output lever are mounted in the internal cavity. In such embodiments, the first output lever may include a first slot, and the first mechanism may further include a support structure fixed within the internal cavity, the support structure including a second slot, and a pin extending through first and second slots and an end of the first input lever. In such embodiments, the first and second slots may be positioned within the first output lever and the first output lever, respectively, so that when the input lever is pivoted in a first direction, the first output lever may pivot in a second direction opposite the first direction.

Yet another non-exclusive example of a toy doll according to the present disclosure may be described as comprising a head that includes a face having an eye, a cheek, and a mouth opening, a torso coupled to the head, a first mechanism for altering the appearance of the face, and a second mechanism for altering the appearance of the face. The first mechanism may include a first input lever extending along the torso and configured to pivot about a first axis, and a cheek-engagement lever coupled to an inside surface of the cheek, coupled to the input lever, and configured to pivot about a second axis so that at least a portion of the cheek moves. In such embodiments the second axis may be generally parallel to the first axis. The second mechanism may include a second input lever positioned behind the mouth opening and configured to be engaged by an object inserted through the mouth opening and further configured to pivot about a third axis generally parallel to the first axis, an eye-positioning lever coupled to the eye, coupled to the second input lever and configured to pivot about a fourth axis so that the eye appears to close. In such embodiments, the fourth axis may be generally parallel to the first axis. Furthermore, the toy doll may include a sound generator configured to output a first sound when the first input lever is pivoted from a first position to a second position and further configured to output a second sound when the second input lever is pivoted from a third position to a fourth position. Furthermore, pivoting the first input lever in a first direction may cause the cheek-engagement lever to pivot in a second direction opposite the first direction, and pivoting the second input lever in the first direction may cause the eye-positioning lever to pivot in the first direction when the toy doll is generally in an upright orientation.

Yet another non-exclusive example of a toy doll according to the present disclosure may be described as comprising a head including a face having an alterable appearance and a first mechanism for altering the appearance of the face and operatively coupled to the head. The first mechanism may include a first element configured to pivot about a first axis between a first position and a second position, and a second element operatively coupled to the first element and configured to pivot about a second axis between a third position and a fourth position in response to the first element pivoting from the first position to the second position. Pivoting of the second element may therefore alter a first aspect of the appearance of the face. The toy doll may further include a second mechanism for altering the appearance of the face and operatively coupled to the head. The second mechanism may include a third element configured to pivot about a third axis between a fifth position and a sixth position, and a fourth element operatively coupled to the third element and configured to pivot about a fourth axis between a seventh position and an eighth position in response to the third element pivoting from the fifth position to the sixth position, wherein pivoting the third element alters a second aspect of the appearance of the face.

Additionally ort alternatively, the toy doll may further include a torso portion that includes an actuator extending along the torso and fixedly coupled to the first element and configured to pivot the first element from the first position to the second position when the actuator is moved by a user.

Additionally or alternatively, the second element may be operatively coupled to a cheek of the doll's face, wherein the cheek is in a ninth position when the second element is in the third position and the cheek is in a tenth position when the second element is in the fourth position.

Additionally or alternatively, the fourth element may include at least one eye, wherein the eye appears to be open when the fourth element is in the seventh position and the eye appears to be closed when the fourth element is in the eighth position.

Additionally or alternatively, the first, second, third, and fourth axes may be generally parallel and when the toy doll is in a first orientation pivoting the first element in a first direction may cause the second element to pivot in a second direction opposite the first direction, and pivoting the third element in the first direction may cause the fourth element to pivot in the first direction.

Additionally or alternatively, when the toy doll is in a second orientation, the fourth element may be in the eighth position regardless of the position of the third element.

Additionally or alternatively, the first orientation of the toy doll may be a generally upright orientation and the second orientation of the toy doll may be a generally laid-back orientation.

Additionally or alternatively, the head may further include a mouth opening, and the third element may be positioned behind the mouth opening and be configured to be engaged by an object inserted through the mouth opening.

Additionally or alternatively, the toy doll may further include a sound generator configured to output a first sound when the first element is pivoted to the second position and further configured to output a second sound when the third element is pivoted to the sixth position.

Yet another non-exclusive example of a toy doll according to the present disclosure may be described as comprising a head including a movable facial feature, a torso coupled to the head, wherein the head and the torso define an internal cavity, and a mechanism for moving the movable facial feature. The mechanism may include a support structure fixed within the internal cavity and including a first slot, an input lever mounted in the internal cavity and configured to pivot about a first axis, an output lever mounted in the internal cavity, coupled to the movable facial feature, and configured to pivot about a second axis, the output lever including a second slot, and a pin extending though the first and second slots and an end of the input lever. In such embodiments, the first and second slots may be positioned within the input support structure and the output lever, respectively, so that when the input lever is pivoted in a first direction the output lever pivots in a second direction opposite the first direction.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

The invention claimed is:

1. A toy doll, comprising:

a head including a first movable facial feature and a second movable facial feature; and a mechanism for moving the first and second movable facial features, the mechanism including:

an input lever configured to pivot about a first axis;

a first output lever coupled to the first movable facial feature, coupled to the input lever, and configured to pivot about a second axis;

a second output lever coupled to the second movable facial feature, coupled to the input lever, and configured to pivot about a third axis;

a first gear portion fixedly attached to the input lever such that the first gear portion is configured to pivot about the first axis when the input lever is pivoted about the first axis;

a pinion gear mounted in the internal cavity and engaged with the first gear portion;

a rack slidingly mounted in the internal cavity and engaged with the pinion; and an output gear configured to pivot about the second axis and fixedly attached to the first output lever such that the first output lever is configured to pivot about the second axis when the output gear pivots about the second axis, the output gear being engaged with the rack, wherein, when the toy doll is in a first orientation, pivoting the input lever about the first axis pivots the first and second output levers about the second and third axes, respectively.

2. The toy doll of claim 1, wherein the first movable facial feature includes one or more cheeks of the toy doll.

3. The toy doll of claim 1, wherein the second movable facial feature includes one or more eyes and the second output lever is configured to move the one or more eyes from an open condition to a closed condition.

4. The toy doll of claim 1, wherein the second output lever is coupled to the input lever via the first output lever so that pivoting the input lever about the first axis pivots the first output lever about the second axis which in turn pivots the second output lever about the third axis.

5. The toy doll of claim 1, wherein when the toy doll is in a second orientation, pivoting the input lever about the first axis pivots the first output lever but not the second output lever.

6. The toy doll of claim 1, wherein the first, second, and third axes are generally parallel and when the toy doll is in the first orientation pivoting the input lever in a first direction causes the second output lever to pivot in the first direction and further causes the first output lever to pivot in a second direction opposite the first direction.

7. The toy doll of claim 1, wherein the mechanism further includes an input member coupled to the second output lever and configured to be generally linearly translated;

wherein when the toy doll is in the first orientation, translation of the input member pivots the second output lever.

8. The toy doll of claim 7, wherein the head includes a mouth opening and the input member is positioned behind the mouth opening to be engaged by an object inserted through the mouth opening.

9. The toy doll of claim 7, further including a sound generator configured to output a first sound when the input lever is pivoted from a first position to a second position and further configured to output a second sound when the input member is translated.

10. The toy doll of claim 1, further comprising a sound generator configured to output a sound when the input fever is pivoted from a first position to a second position.

11. The toy doll of claim 1, further comprising a torso portion coupled to the head;

wherein the head and the torso portion define an internal cavity and the input lever, the first output lever, and the second output lever are mounted in the internal cavity.

12. The toy doll of claim 11, wherein the head further includes a mouth opening, and wherein the mechanism further includes:

an input member coupled to the second output lever, configured to be generally linearly translated, and positioned within the mouth opening to be engaged by an object inserted in the mouth opening; and a transition lever configured to pivot about a fourth axis, the transition lever in contact with the input member at a first portion and, when the toy doll is in the first orientation, in contact with the second output lever at a second portion;

wherein when the toy doll is in the first orientation, translation of the input member pivots the second output lever.

13. A toy doll, comprising:

a head including a face having an eye, a cheek, and a mouth opening;

a torso coupled to the head; and a mechanism for altering the appearance of the face, the mechanism including:

an input lever integral to the torso and configured to pivot about a first axis;

a cheek-engagement lever coupled to an inside surface of the cheek, coupled to the input lever, and configured to pivot about a second axis so that at least a portion of the cheek moves, wherein the second axis is generally parallel to the first axis;

an eye-positioning lever coupled to the eye, coupled to the input lever via the cheek-engagement lever, and configured to pivot about a third axis so that the eye appears to close, wherein the third axis is generally parallel to the first axis;

a tongue member positioned behind the mouth opening, the tongue member coupled to the eye-positioning lever such that, when the doll is in a first orientation, insertion without rotation of an object through the mouth opening pivots the tongue member, which in turn pivots the eye-positioning lever about the third axis and, when the doll is in a second orientation different from the first orientation, insertion without rotation of an object through the mouth opening pivots the tongue member, which in turn does not pivot the eye-positioning lever about the third axis when the doll is in a second orientation and an object is inserted through the mouth opening; and a sound generator configured to output a first sound when the input lever is pivoted from a first position to a second position and further configured to output a second sound when the tongue member is translated;

wherein, when the toy doll is generally in an upright orientation, pivoting the input lever in a first direction causes the eye-positioning lever to pivot in the first direction and further causes the cheek-engagement lever to pivot in a second direction opposite the first direction.

* * * * *